United States Patent [19]

Fishman et al.

[11] Patent Number: 4,765,506

[45] Date of Patent: Aug. 23, 1988

[54] COMBINATION STORAGE CONTAINER AND TRIPLE SEAL LID

[75] Inventors: Aaron H. Fishman, Hewlett Harbor, N.Y.; Joseph Bottitta, Belleville, N.J.

[73] Assignee: APL Corporation, Miami Beach, Fla.

[21] Appl. No.: 49,764

[22] Filed: May 12, 1987

[51] Int. Cl.[4] ..... B65D 43/06

[52] U.S. Cl. ..... 220/355; 150/55; 220/356

[58] Field of Search ..... 220/306, 355, 356; 150/55

[56] References Cited

U.S. PATENT DOCUMENTS 3,732,909 5/1973 Rooke et al. ..... 220/356

4,471,880 9/1984 Taylor et al. ..... 220/306

*Primary Examiner*—George T. Hall

*Attorney, Agent, or Firm*—Caesar, Rivise, Bernstein, Cohen & Pokotilow, Ltd.

[57] ABSTRACT

A combination container and lid for storing food or other air perishable products. The container includes a wall having a sealing rim extending about the periphery thereof. The rim includes three surfaces. The lid includes peripheral sealing means in the form of a peripheral flange and an annular rib spaced from the flange and defining therebetween an annular recess. The annular recess is adapted to receive the rim of the container. The flange is somewhat resilient and includes an angled surface to cooperate with a portion of the rim to insure that the rim is fully seated with the recess, whereupon three separate annular, fluid-tight seals are produced.

2 Claims, 2 Drawing Sheets

FIG. 1
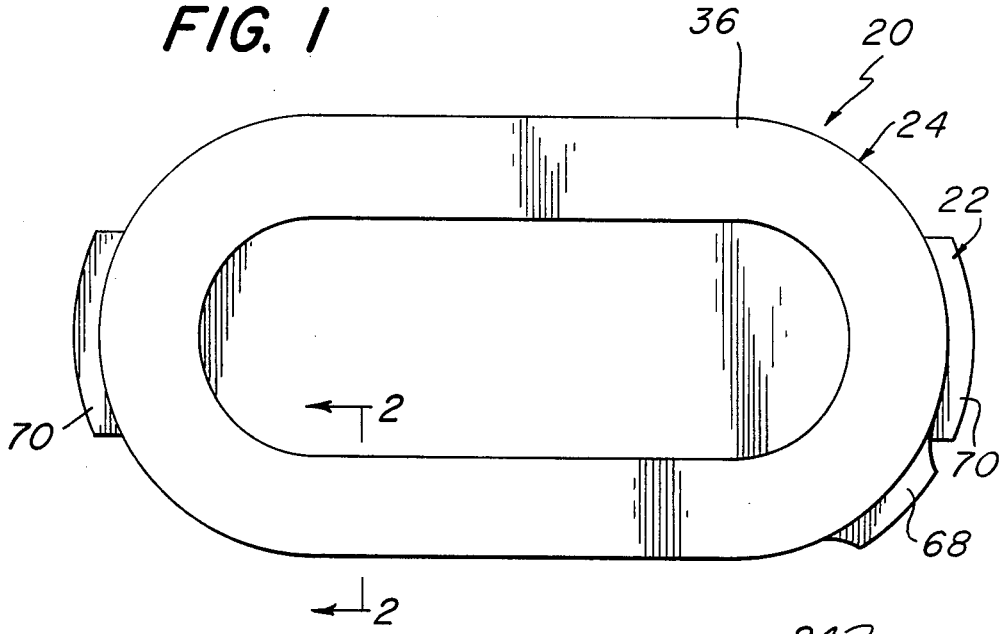
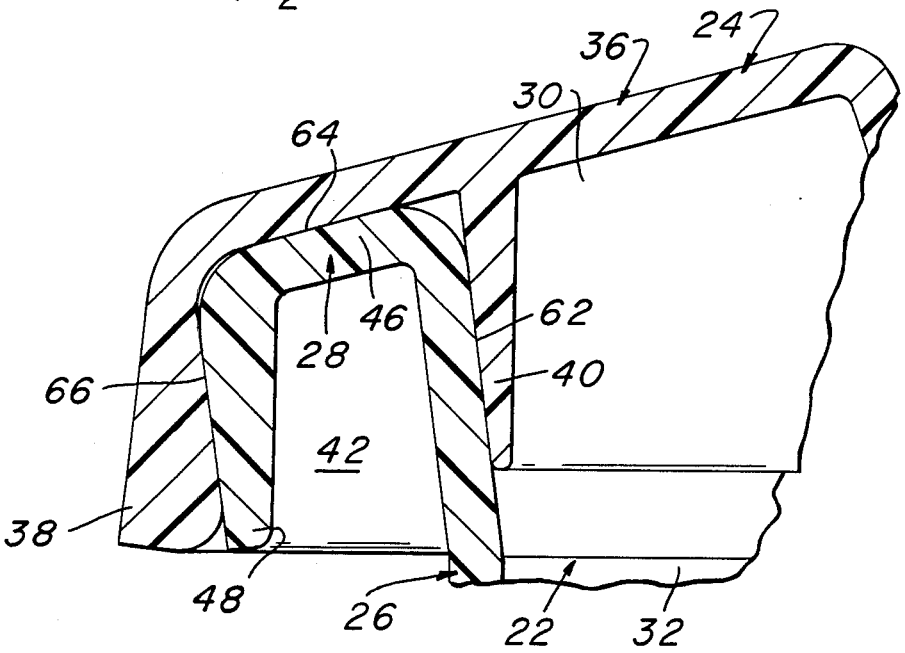
FIG. 2

COMBINATION STORAGE CONTAINER AND TRIPLE SEAL LID

BACKGROUND OF THE INVENTION

This invention relates generally to containers and lids therefore, and more particularly to containers with lids for hermetically sealing foodstuffs or other perishable goods therein.

Various containers and covers for hermetically sealing foodstuffs are disclosed in the patent literature and many are commercially available. Such containers and their covers are typically made of plastic, such as polypropylene, polyethylene or other locally deformable, yet resilient compositions.

While prior art containers and their lids have proved generally suitable for their intended purposes, such devices may develop leaks or weak seals between the lid and the container as a result of misalignment or misfitting of the cover and container. Moreover even when the lid is aligned and properly fitted on the cover, air or liquid leakage can still occur through the seal between the lid and container.

OBJECTS OF THE INVENTION

It is therefore the object of this invention to overcome the disadvantages of prior art containers and covers therefore.

It is still a further object of the instant invention to provide a container and lid therefore which includes multiple seals to insure that a good air or liquid-tight seal is maintained between the lid and the container.

It is still a further object of the instant invention to provide a container and a lid which is relatively simple in construction and can be manufactured inexpensively, yet which provides a secure seal therebetween.

SUMMARY OF THE INVENTION

These and other objects of the instant invention are achieved by providing the combination of a plastic container and lid. The combination is arranged to store food or other air perishable goods therein. The container comprises a body having a side wall defining a mouth to the interior of the container and having a rim extending about the periphery thereof. The rim includes an outwardly extending portion terminating in a downwardly extending flange. The container has a first surface formed by a portion of the inner surface of its side wall, a second surface formed by a portion of the top surface of its outwardly extending rim portion and a third surface formed by a portion of the outer surface of the rim's flange. The lid comprises a central portion and a peripheral sealing portion. The peripheral portion has a bottom surface which defines a second surface of the lid, a downwardly projecting flange extending about the periphery of the lid and having an inner surface defining a first surface of the lid, and a downwardly projecting rib spaced inwardly from the flange and having an outer surface defining a third surface of the lid. The first, second and third surfaces of the lid form an annular space therebetween. The lid is arranged to be releasably secured to the container with the lid's rim disposed within the annular space. The first, second and third surfaces of the lid and container are configured and sized so that the rim is tightly received within the annular space with the first, second and third surfaces of the lid tightly engaging the first, second and third surfaces, respectively, of the container to create respective first, second and third, liquid-tight seals.

DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 1 is a top plan view of the combination container and lid embodying the invention;

FIG. 2 is an enlarged sectional view taken along line 2—2 of FIG. 1;

DETAILED DESCRIPTION OF THE PREFERRED EMBODIMENT

Figure 3:
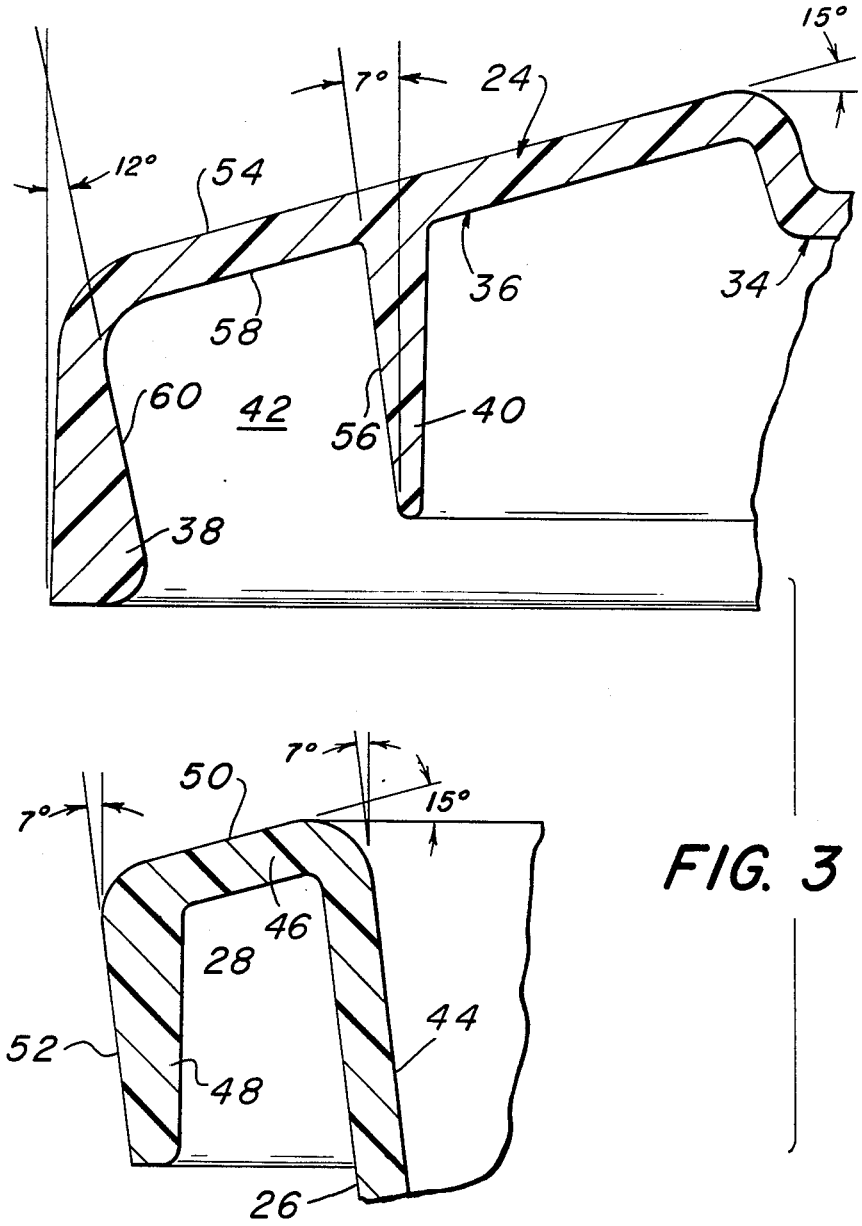
FIG. 3 is an exploded sectional view of the portions of the container and lid shown in FIG. 2 but prior to their securement to each other.

Referring now to various figures of the drawing wherein like reference characters refer to like parts, a combination container and lid embodying the invention is shown generally at 20 in FIG. 1. The combination basically comprises a container 22 and a lid 24. It should be noted that the combination 20 shown in FIG. 1 and embodying the invention is of a flat oval shape, but the principal of this invention applies as well to other shapes of containers and lids therefore, such as rectangular, square, circular, etc.

As seen clearly in FIG. 2 the container 22 basically comprises a hollow body formed by a sidewall structure, generally identified by the reference numeral 26, and a bottom wall (not shown). The bottom wall is positioned at the lower end of the sidewall 26 and serves as the support surface of the container. A sealing rim or lip 28 extends about the periphery of the top of the sidewall and defines within its boundary an open end or mouth 30 of the container 22. The mouth provides access to the hollow interior 32 of the container 22. The details of the sealing rim 28 will be described later. Suffice it for now to state that the rim is adapted to be received within an annular space, to be described later, in the lid to form three good hermetic and/or liquid-tight seals therebetween. In accordance with the preferred embodiment of the invention each of the seals extends about the entire periphery of the junction between the lid and container.

Access to the interior 32 of the container is provided via the open mouth 30 of the container 22 when the lid 24 is removed. The lid 24 is of the same general overall shape as the container 22 and includes a generally planar central portion 34 (FIG. 3) and sealing means 36 extending about the periphery of the central portion. The sealing means 36 will be described in considerable detail later. Suffice it for now to state that the sealing means 36 includes a downwardly projecting flange 38 extending about the entire periphery of the lid 24. An annular rib 40 also projects downward from the underside of the lid and is spaced inward from the flange 38. The space between the flange 38 and the rib 40 defines an annular recess 42 (FIG. 3) which is adapted to tightly receive the container's rim 28 therein when the lid is in place.

In accordance with a preferred embodiment of the invention the container is formed of any suitable plastic material, such as polypropylene. The cover or lid 24 is also formed of any suitable plastic material which is somewhat deformable, yet resilient, such as a medium density polyethylene.

Referring now to FIGS. 2 and 3, the details of the rim 28 will now be described. As can be seen therein the upper end of the container's sidewall 26 is flared slightly outward so that in its inner surface 44 extends at a slight acute angle, e.g., 7° to the vertical. The upper portion of surface 44 forms a first engagement surface of the rim. The rim 28 also includes an outwardly extending portion 46 and terminates in a downwardly extending flange portion 48. The top surface 50 of portion 46 is conical and extends at a slight acute angle, e.g, 15°, down from the horizontal. This top surface forms a second engagement surface of the rim. The flange 48 includes an outer surface 52 which also extends at a slight acute angle, e.g., 7° from the vertical and hence is at the same angle as surface 44. The outer surface 52 forms a third engagement surface of the rim. The three engagement surfaces 44, 50 and 52 are arranged to cooperate with three corresponding surfaces, to be described later, on the underside of the lid at its sealing means 36.

Referring now to FIG. 3 the details of the sealing means 36 will now be described. As can be seen the sealing means 36 includes a generally planar top surface 54 which extends downward at a slight acute angle, e.g., 15°, from the horizontal when the lid is horizontal. The lid's rib 40 includes an outer surface 56 which extends at a small acute angle, e.g., 7°, to the vertical when the lid is disposed horizontally. This outer surface forms a first engagement surface of the lid. The underside of sealing means 36 is in the form of a generally conical surface with the portion thereof between the rib 56 and the flange 38 defining a lower surface 58. The lower surface 58 forms a second engagement surface of the lid. The flange 38 flares in cross-section from its upper end to its lower or free end so that its inner surface 60 extends at a small acute angle, e.g., 12°, to the vertical. This inner surface 60 forms a third engagement surface of the lid. The surfaces 56, 58 and 60 define therebetween the heretofore identified annular recess 42.

The securement of the lid 24 to the container 22 to seal foodstuffs or other products within the container and out of contact with the ambient air is effected as follows: the lid is placed over the container so that the rim 28 is generally aligned with the annular recess 42. The lid is then pushed downward, whereupon the lid's flange 38 engages the radiused corner forming the interface of the rim's surfaces 50 and 52. This action causes the flange to pivot slightly outward to slide downward on outer surface 52. Accordingly, the angle that the flange's inner surface 58 makes with the vertical is now the same as the angle of rim surface 52, i.e., approximately equal to 7°, from its previous 12° inclination. At the same time rim surface 56 slides along surface 44. This action enables the rim to be slid completely into the recess 42. The natural bias of the flange 38, and the bias of the rib 40 cooperate with each other on the abuting surfaces of the container's rim to automatically draw the rim 28 as deeply as possible into the recess. This action insures that the inner surface 44 of the sidewall of the container intimately engages the outer surface 56 of the rib in a first fluid-tight seal 62 (FIG. 2), the top surface 50 of the rim 28 intimately engages the undersurface 58 of the lid in a second fluid-tight seal 64 (FIG. 2) and the outer surface 52 of the rim's flange 48 intimately engages the inner surface 60 of the lid's flange 38 in a third fluid-tight seal 66 (FIG. 2).

In order to facilitate the removal of the lid 24 from the container 22, the lid includes a tab 68 projecting from one end thereof. This tab provides a place for one to grip the lid to pull it off the container.

As can be seen in FIG. 1 the container 22 also includes a pair of projecting handles 70, one at each end of the container. The handles 70 serve as means to enable the container to be readily transported.

Without further elaboration the foregoing will so fully illustrate our invention that others may, by applying current or future knowledge, adopt the same for use under various conditions of service.

We claim:

1. The combination of a plastic container and lid, said combination being arranged for storing food stuffs or other goods therein with said lid secured in place on said container, said container comprising a sidewall defining a mouth to the interior of said container and having a rim extending about the periphery thereof, said rim including an outwardly extending portion termination in a downwardly extending flange, said container having a first surface formed by a portion of the inner surface of said sidewall, a second surface formed by a portion of the top surface of the outwardly extending portion of said rim, and a third surface formed by a portion of the outer surface of said flange, said second surface including a portion of conical shape projecting downward, said first and third surfaces of said container each extending at an angle of approximately 7° from the vertical direction when said container is disposed horizontally, said second surface portion extending at an angle of approximately 15° to the horizontal when said container is disposed horizontally said lid being formed of a somewhat flexible material and comprising a central portion and a peripheral portion, said peripheral portion having a bottom surface defining a second surface of said lid, a downwardly projecting flange extending about the periphery of said lid and having an inner surface defining a third surface of said lid, and a downwardly projecting rib spaced inwardly from said flange and having an outer surface defining a first surface of said lid, said second surface of said lid including a portion of conical shape projecting downward, said first and third surfaces of said lid extending at angles of approximately 7° and 12°, respectively, from the vertical direction, when said lid is disposed horizontally, said second surface portion of said lid extending at an angle of approximately 15° from the horizontal direction when said lid is disposed horizontally, said first, second and third surfaces of said lid forming an annular space therebetween, said lid being arranged to be releasably secured to said container with said flange of said lid flexing so that said rim is disposed within said annular space, said first, second and third surfaces of said lid and container being configured and sized so that after said flange flexes the rim is tightly received within said annular space and with said first, second and third surfaces of said lid tightly engaging said first, second and third surfaces, respectively, of said container to create respective first, second and third, liquid-tight seals.

2. The container of claim 1 wherein said plastic material forming said lid is a medium density polyethylene.

* * * * *